US006904700B2

(12) United States Patent
Hada et al.

(10) Patent No.: US 6,904,700 B2
(45) Date of Patent: Jun. 14, 2005

(54) APPARATUS FOR DRYING A TISSUE WEB

(75) Inventors: Frank S. Hada, Appleton, WI (US); Michael Alan Hermans, Neenah, WI (US); Ronald F. Gropp, St. Catharines (CA)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 61 days.

(21) Appl. No.: 10/661,826

(22) Filed: Sep. 12, 2003

(65) Prior Publication Data

US 2005/0072023 A1 Apr. 7, 2005

(51) Int. Cl.[7] ..... F26B 11/02
(52) U.S. Cl. ..... 34/117; 34/120; 34/114
(58) Field of Search ..... 34/114, 117, 120, 34/629, 633, 632

(56) References Cited

U.S. PATENT DOCUMENTS

| | | | | |
|---|---|---|---|---|
| 3,432,936 A | | 3/1969 | Cole et al. | |
| 3,739,491 A | | 6/1973 | Creapo et al. | |
| 3,807,059 A | | 4/1974 | Lopata | |
| 4,036,684 A | | 7/1977 | Schmitt et al. | |
| 4,124,942 A | | 11/1978 | Ohls et al. | |
| 4,194,947 A | | 3/1980 | Huostila et al. | |
| 4,247,990 A | | 2/1981 | Ohls et al. | |
| 4,481,722 A | | 11/1984 | Guy et al. | |
| 4,606,137 A | | 8/1986 | Whipple | |
| 4,785,759 A | | 11/1988 | Motoyama et al. | |
| 4,876,803 A | | 10/1989 | Wedel | |
| 4,905,380 A | | 3/1990 | Eskelinen et al. | |
| 5,020,241 A | | 6/1991 | Fleissner | |
| 5,068,980 A | | 12/1991 | Müller | |
| 5,241,760 A | | 9/1993 | Wedel | |
| 5,477,624 A | | 12/1995 | Haessner et al. | |
| 5,515,619 A | | 5/1996 | Kahl et al. | |
| 5,569,359 A | | 10/1996 | Joiner | |
| 5,575,084 A | | 11/1996 | Vuorinen | |
| 5,722,180 A | | 3/1998 | Joiner | |
| 5,881,472 A | * | 3/1999 | Grunder et al. | 34/114 |
| 5,887,358 A | | 3/1999 | Bischel et al. | |
| 5,921,000 A | * | 7/1999 | Wedel et al. | 34/117 |
| 5,933,979 A | | 8/1999 | Wedel | |
| 5,974,691 A | | 11/1999 | Marchal et al. | |
| 6,018,455 A | | 1/2000 | Wilkie, II et al. | |
| 6,018,886 A | | 2/2000 | Bell et al. | |

(Continued)

FOREIGN PATENT DOCUMENTS

| | | |
|---|---|---|
| EP | 0980497 A3 | 3/2000 |
| EP | 0984097 A2 | 3/2000 |

OTHER PUBLICATIONS

Abstract of WO90/12151, Oct. 18, 1990.

*Primary Examiner*—Denise L. Esquivel
*Assistant Examiner*—Kathryn S. O'Malley
(74) *Attorney, Agent, or Firm*—Dority & Manning, P.A.

(57) ABSTRACT

A through-air drying apparatus is disclosed. The through-air drying apparatus includes a rotating drying cylinder over which a tissue web is carried and dried. A hood surrounds the drying cylinder leaving an open free end. In accordance with the present invention, an external baffle is positioned adjacent to the open free end of the drying cylinder to prevent external air from leaking in or infiltrating the drying cylinder.

43 Claims, 5 Drawing Sheets

U.S. PATENT DOCUMENTS 6,032,385 A 3/2000 Bischel et al.
6,074,462 A 6/2000 Quinn et al.
6,079,116 A 6/2000 Jewitt et al.
6,083,346 A 7/2000 Hermans et al.
6,093,284 A 7/2000 Hada et al.
6,143,135 A 11/2000 Hada et al.
6,149,767 A 11/2000 Hermans et al.
6,199,296 B1 3/2001 Jewitt
6,228,220 B1 5/2001 Hada et al.
6,306,257 B1 10/2001 Hada et al.
6,331,230 B1 12/2001 Hermans et al.
6,398,916 B1 6/2002 Klerelid
6,454,904 B1 9/2002 Hermans et al.
6,551,461 B2 4/2003 Leitner et al.
6,585,086 B2 7/2003 Sandberg et al.
6,610,173 B1 8/2003 Lindsay et al.
6,732,452 B2 5/2004 Lin et al.
6,772,533 B2 * 8/2004 Hassinen et al. ..... 34/120

* cited by examiner

APPARATUS FOR DRYING A TISSUE WEB

BACKGROUND OF THE INVENTION

In the manufacture of high-bulk tissue products, such as facial tissue, bath tissue, paper towels, and the like, it is common to use one or more throughdryers for partially drying the web or to bring the tissue web to a final dryness or near-final dryness. Generally speaking, throughdryers typically include a rotating cylinder having an upper deck that supports a drying fabric which, in turn, supports the web being dried. In particular, heated air is passed through the web in order to dry the web. For example, in one embodiment, heated air is provided by a hood above the drying cylinder. Alternatively, heated air is provided to a center area of the drying cylinder and passed through to the hood.

When incorporated into a papermaking system, throughdryers offer many and various benefits and advantages. For example, throughdryers are capable of drying tissue webs without compressing the web. Thus, moisture is removed from the webs without the webs losing a substantial amount of bulk or caliber. In fact, throughdryers, in some applications, may even serve to increase the bulk of the web. Throughdryers are also known to contribute to various other important properties and characteristics of the webs.

The use of throughdryers, however, can be expensive. For instance, in addition to the capital costs associated with the equipment, throughdryers have relatively high energy requirements. Therefore, a need currently exists for a system and process for reducing the energy costs associated with throughdryers, while still retaining all the benefits and advantages to using throughdryers.

In this regard, in the past, those skilled in the art have attempted to prevent the heated air used to dry tissue webs from leaking out of the throughdryer and also have attempted to prevent cooler ambient air from leaking into the throughdryer during use. In order to prevent leaks, throughdryers have been equipped with internal seals and baffles. The internal seals and baffles have been placed, for instance, adjacent to an open end of the drying cylinder, where the drying cylinder is not covered by the hood.

Although internal baffles have shown to be somewhat effective at sealing the throughdryer, cool air still becomes entrained in the drying cylinder, which typically has a substantial thickness. This carryover of air corresponding to the thickness of the drying cylinder is commonly referred to as "shell dump". As the drying cylinder rotates, cool ambient air is drawn into the throughdryer reducing the efficiency of the process. Thus, a need currently exists for a system and process for minimizing shell dump.

SUMMARY OF THE INVENTION

In general, the present invention is directed to a system and process for through-air drying paper webs, mainly tissue webs. For example, in one embodiment, the present invention is directed to an apparatus for drying a tissue web that comprises a through-air dryer. The through-air dryer includes a porous drying cylinder configured to permit gas flow therethrough and a hood surrounding a portion of the drying cylinder leaving an open free end. A throughdrying fabric is wrapped around the drying cylinder from an upstream point to a downstream point. The throughdrying fabric may be guided around the drying cylinder, for instance, by an upstream guide device and a downstream guide device.

In accordance with the present invention, the apparatus further includes an external baffle positioned over the open free end of the drying cylinder. In one embodiment, the external baffle comprises at least 2 plates. The plates are connected together in a manner that permits thermal expansion of the baffle. The external baffle shields the open free end of the drying cylinder from external air, thus minimizing shell dump.

In one embodiment, the plates that comprise the external baffle are connected by a connection device. At least one of the plates defines a slot that surrounds the connection device that permits relative movement of the plates. For example, the plates of the baffle may be connected in a manner such that the plates are allowed to slide over one another when undergoing thermal expansion. In one embodiment, the external baffle may be used in connection with an internal baffle positioned within the drying cylinder.

In general, the external baffle extends from the downstream point to the upstream point of the throughdrying fabric without contacting the fabric. In order to place the baffle as close as possible to the throughdrying fabric, each end of the baffle may have an adjustable length for positioning the external baffle appropriately. Each end of the baffle may also be coated with an anti-friction coating, such as a TEFLON fluorocarbon coating, should contact occur between the baffle and the fabric. In one embodiment, the ends of the baffle are positioned so as to overlap with the ends of the hood surrounding the drying cylinder.

In accordance with the present invention, the apparatus can also include a baffle support for positioning the external baffle adjacent to the drying cylinder. The baffle support can be in fluid communication with a cooling system configured to cool the baffle support. By cooling the baffle support, the baffle support is capable of maintaining the ends of the baffle in a fixed position during thermal expansion of the baffle.

In one embodiment, the baffle support may include a plurality of hollow support elements spaced along the external baffle. The support elements may be in fluid communication with each other for receiving a cooling fluid. The cooling system used to cool the baffle support may include a cooling fluid source in communication with at least one cooling fluid channel that is formed in the baffle support. The cooling fluid may be, for instance, a liquid or a gas, such as water or air.

In one embodiment, the apparatus of the present invention may be configured such that the throughdrying fabric conveys the tissue web through the through-air dryer without contacting any papermaking rolls. Contact with a papermaking roll may damage the tissue web or create pinholes.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
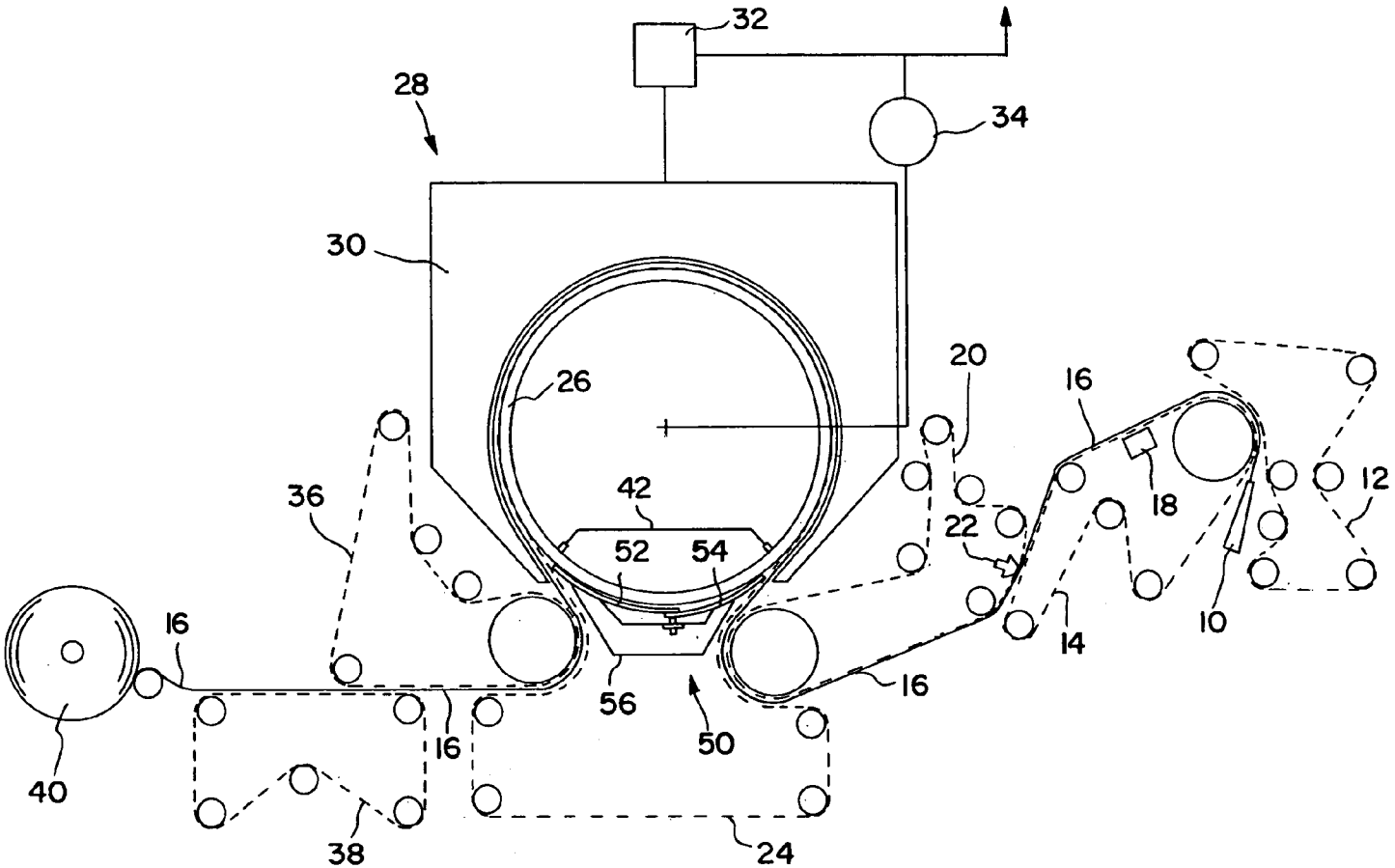
FIG. 1 is a side view of one embodiment of a papermaking system in accordance with the present invention.

Repeated use of reference characters in the present specification and drawings is intended to represent the same or analogous features or elements of the invention.

DETAILED DESCRIPTION

It is to be understood by one of ordinary skill in the art that the present discussion is a description of exemplary embodiments only, and is not intended as limiting the broader aspects of the present invention.

In general, the present invention is directed to an improved system and process for through-air drying paper webs, particularly tissue webs. More particularly, the efficiency of a through-air dryer is improved according to the present invention by placing an external baffle adjacent to an open free end of a drying cylinder contained in the through-air dryer. The external baffle shields the open free end of the drying cylinder from external air. In this manner, ambient air is prevented from being entrained in the drying cylinder as the drying cylinder rotates. By preventing ambient air from entering the drying cylinder, the through-air dryer operates more efficiently reducing the energy requirements needed to dry a tissue web.

For purposes of illustration, for instance, one embodiment of a papermaking process made in accordance with the present invention is shown in FIG. 1. As illustrated, the system includes a head box 10 which injects and deposits a stream of an aqueous suspension of papermaking fibers between a first forming fabric 12 and a second forming fabric 14. The forming fabric 14 serves to support the newly-formed wet web 16 downstream in the process as the web is partially dewatered to a consistency of about 10 dry weight percent. Additional dewatering of the wet web 16 can be carried out, such as by vacuum suction, using one or more vacuum boxes 18. As shown, the vacuum box 18 is positioned below the forming fabric 14. The vacuum box 18 applies a suction force to the wet web thereby removing moisture from the web.

From the forming fabric 14, the wet web 16 is transferred to a transfer fabric 20. The transfer may be carried out using any suitable mechanism. As shown in FIG. 1, in this embodiment, the transfer of the web from the forming fabric 14 to the transfer fabric 20 is done with the assistance of a vacuum shoe 22.

In one embodiment, the web 16 may be transferred from the forming fabric 14 to the transfer fabric 20 while the transfer fabric 20 is traveling at a slower speed than the forming fabric 14. For example, the transfer fabric may be moving at a speed that is at least 5%, at least 8%, or at least 10% slower than the speed of the forming fabric. This process is known as "rush transfer" and may be used in order to impart increased machine direction stretch into the web 16.

From the transfer fabric 20, the tissue web 16 is transferred to a throughdrying fabric 24 and carried around a drying cylinder 26 of a through-air dryer generally 28. As shown, the through-air dryer 28 includes a hood 30. Hot air used to dry the tissue web 16 is created by a burner 32. More particularly, a fan 34 forces hot air created by the burner 32 into the hood 30. Hood 30 directs the hot air through the tissue web 16 carried on the throughdrying fabric 24. The hot air is drawn through the web and through the drying cylinder 26 which is perforated. More particularly, the drying cylinder has a honeycomb-type structure that permits air flow through the drying cylinder but yet has sufficient integrity for use in the process.

At least a portion of the hot air is re-circulated back to the burner 32 using the fan 34. In one embodiment, in order to avoid the build-up of moisture in the system, a portion of the spent heated air is vented, while a proportionate amount of fresh make-up air is fed to the burner 32.

In the embodiment shown in FIG. 1, heated air travels from the hood 30 through the drying cylinder 26. It should be understood, however, that in other embodiments, the heated air may be fed through the drying cylinder 26 and then forced into the hood 30.

While supported by the throughdrying fabric 24, the tissue web 16 is dried to a final consistency of, for instance, about 94% or greater by the through-air dryer 28. The tissue web 16 is then transferred to a second transfer fabric 36. From the second transfer fabric 36, the dried tissue web 16 may be further supported by an optional carrier fabric 38 and transported to a reel 40. Once wound into a roll, the tissue web 16 may then be sent to a converting process for being calendered, embossed, cut and/or packaged as desired.

In the system and process shown in FIG. 1, only a single through-air dryer 28 is shown. It should be understood, however, that the system may include a plurality of through-air dryers if desired. For example, in one embodiment, a pair of through-air dryers may be arranged in series. One through-air dryer may be for partially drying the web while the second through-air dryer may be for completing the drying process.

Figure 2:
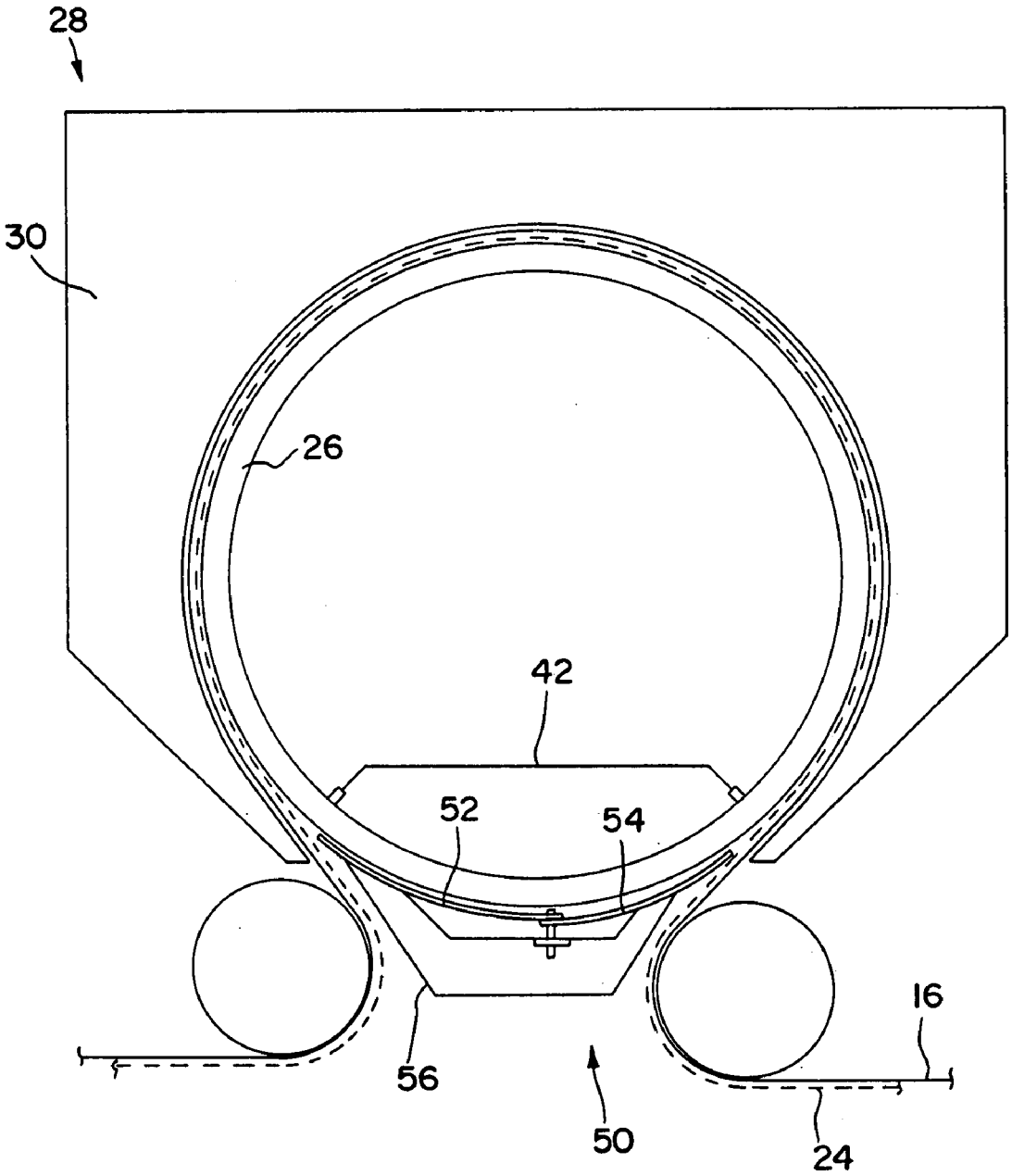
FIG. 2 is a side view of one embodiment of a through-air dryer made according to the present invention.

Referring to FIG. 2, an isolated and enlarged view of the through-air dryer 28 is shown. As illustrated, the hood 30 surrounds a substantial portion of the drying cylinder 26. As shown in FIGS. 1 and 2, however, the hood 30 leaves an open free end of the drying cylinder 26 that remains uncovered. This open free end of the drying cylinder 26 generally also corresponds to the portion of the drying cylinder that is not wrapped by the throughdrying fabric 24.

In the past, in order to prevent cooler, ambient air from entering the drying cylinder, through-air dryers included internal baffles and seals to prevent cool outside air leaking in. For example, as shown in FIGS. 1 and 2, the through-air dryer 28 includes an internal baffle 42 positioned adjacent the open free end of the drying cylinder 26. Although internal baffles, such as baffle 42, are effective at preventing air from directly entering the drying cylinder 26. Air, however, may still become entrained in the drying cylinder 26 as it rotates due to the thickness of the cylinder. Specifically, air becomes entrained in the drying cylinder and, as the drying cylinder rotates, the air is allowed to enter into the center area of the cylinder. This carry over of air corresponding to the thickness of the cylinder is commonly referred to as a shell dump. In some circumstances, the air entering the drying cylinder due to shell dump can be up to as much as 10% of the total air flow. The cooler air that enters the drying cylinder during shell dump adversely affects the overall efficiency of the through-air dryer 28.

Thus, in accordance with the present invention, the through-air dryer 28 is equipped with an external baffle 50 as shown in FIGS. 1 and 2. As illustrated, the external baffle 50 is placed on the outside of the drying cylinder 26 adjacent to the open free end. The external baffle 50 extends from an upstream point of the throughdrying fabric to a downstream point of the throughdrying fabric. For most applications, however, the baffle does not contact the throughdrying fabric. The external baffle 50 prevents air from being entrained in the drying cylinder as the drying cylinder rotates. Inclusion of the baffle 50 can significantly increase the overall efficiency of the through-air dryer 28.

In one embodiment, the external baffle 50 as shown in FIGS. 1 and 2 may be used in conjunction with the internal baffle 42. When used in conjunction with the internal baffle 42, the through-air dryer 28 contains two levels of protection for preventing ambient air from infiltrating the system.

In other embodiments, however, the external baffle 50 may be used to replace the internal baffle 42. By replacing the internal baffle, the construction of the through-air dryer becomes simplified. For instance, internal supports needed to support the internal baffle are no longer necessary.

Figure 3:
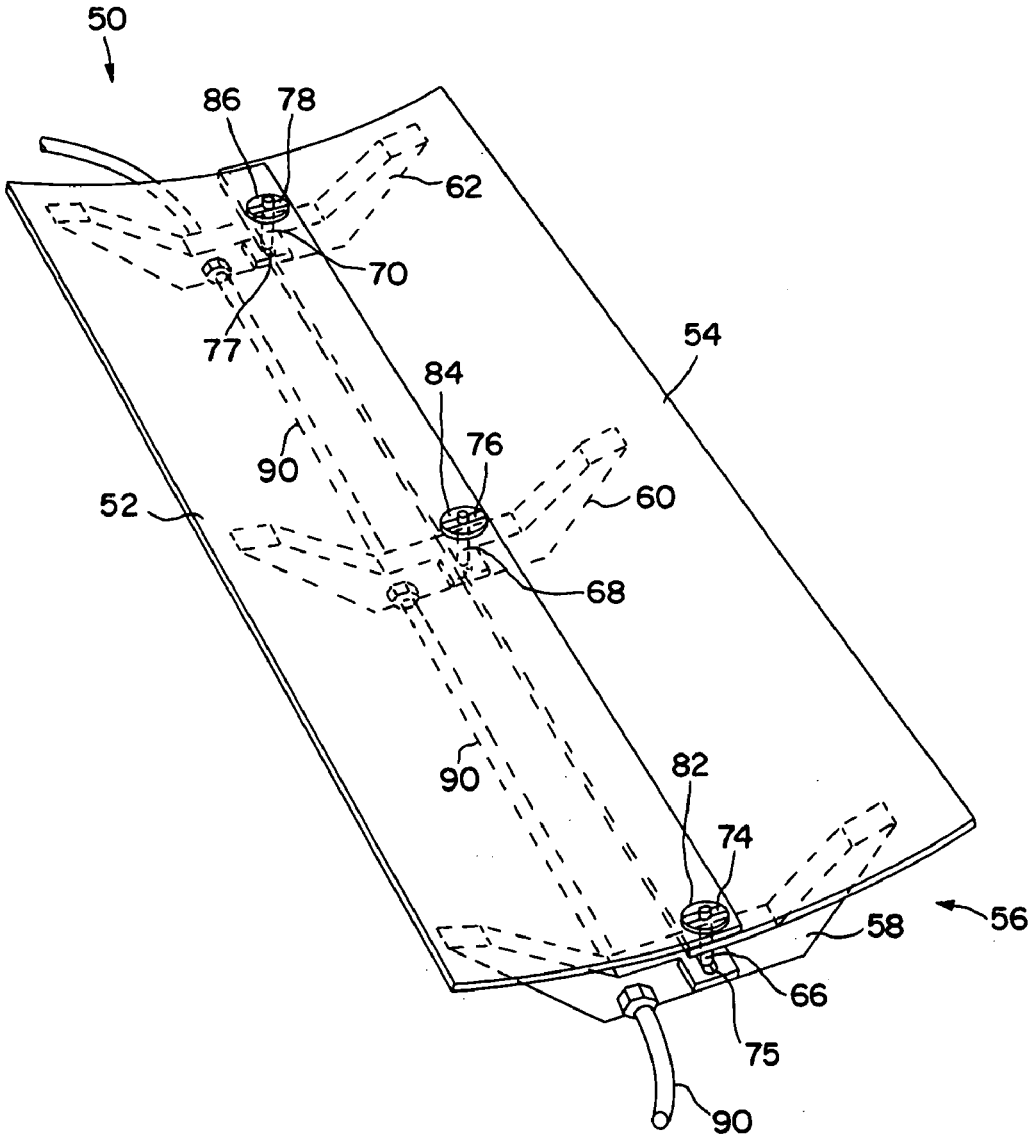
FIG. 3 is a perspective view of one embodiment of an external baffle for use with a through-air dryer in accordance with the present invention.
Figure 4:
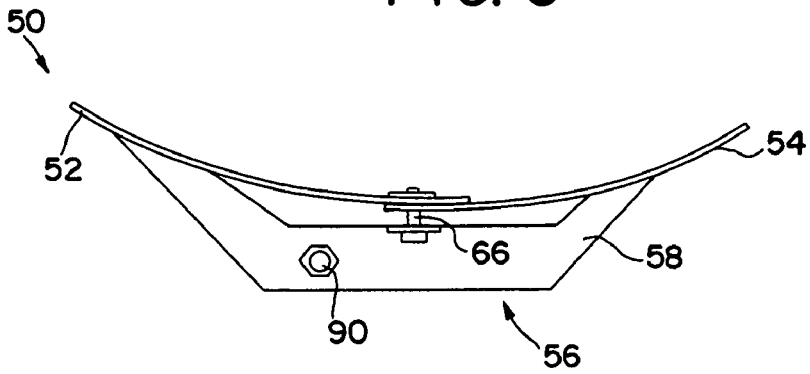
FIG. 4 is a side view of the external baffle illustrated in FIG. 3.

Referring to FIGS. 3 and 4, one embodiment of an external baffle 50 is shown. In general, the external baffle 50 includes a plurality of baffle plates connected to a baffle support system. The baffle support system maintains the baffle in correct position.

For instance, in the embodiment shown in FIGS. 3 and 4, the external baffle includes a first baffle plate 52 and a second baffle plate 54. A baffle support generally 56 includes a plurality of support elements 58, 60 and 62 that are connected to the baffle plates. In this embodiment, each support element is connected to a connection device 66, 68 and 70 which further connect the baffle support 56 to the baffle plates 52 and 54. In particular, the connection devices connect to the baffle plates 52 and 54 where they intersect.

During operation of the through-air dryer 28, the external baffle 50 increases in temperature. For example, through-air dryers are typically operated at temperatures of from about 200° F. to about 500° F. During heating of the external baffle, the present inventors have recognized that the baffle, in most applications, will undergo thermal expansion. During thermal expansion, the external baffle 50 may change position and contact either the throughdrying fabric or the drying cylinder. In order to correct this problem, the external baffle 50 is designed to maintain the same seal clearance with the throughdrying fabric independent of operating temperature. Since all expansion takes place between the supports 58, 60 and 62, movement of the baffle at the critical juncture between the extremities of the plates 52 and 54 is minimized, reducing the risk of contact between the plates and the fabric and the dryer surface. For example, the external baffle 50 as shown in FIGS. 3 and 4 is made out of a plurality of plates which are movable relative to one another when undergoing thermal expansion. Further, the baffle plates 52 and 54 are connected to the baffle support 56 which is maintained at ambient temperature. During heating of the baffle 50, the plates 52 and 54 are permitted to slide over each other, while the baffle support 56 remains at ambient temperature and continues to support the baffle in the same location.

For example, in order to permit thermal expansion of the baffle, the baffle plates 52 and 54 are capable of sliding over each other along the center of the baffle where the connection devices 66, 68 and 70 are located. As shown in FIG. 3, for example, at least one of the baffle plates defines a slot through which the connection devices extend. In FIG. 3, baffle plate 52 defines slots 74, 76 and 78. The slots permit the baffle plate 52 to slide over the baffle plate 54 in the machine direction during thermal expansion. Baffle plate 54 can similarly include slots if desired. As also shown in FIG. 3, the baffle plates 52 and 54 are held on the connection devices 66, 68 and 70 by retaining rings 82, 84 and 86. The retaining rings can be, for instance, threaded nuts or any other suitable device.

The baffle support 56 holds the baffle plates 52 and 54 in position, even during thermal expansion. The baffle support also prevents the baffle plates from being drawn against the drying cylinder during operation of the through-air dryer 28. In particular, when the through-air dryer is operating, a suction force may develop around the drying cylinder which may have a tendency to draw the baffle towards the cylinder.

As described above, the slots 74, 76 and 78 permit the baffle plates 52 and 54 to move relative to one another in the machine direction. As shown in FIG. 3, similar slots 75 and 77 may be included on the baffle support for permitting thermal expansion in the cross machine direction. In FIG. 3, the slots 75 and 77 are formed integral with the support elements 58 and 62. In an alternative embodiment, however, the slots 75 and 77 may be formed into the baffle plates themselves. Thermal expansion takes place in the cross machine direction due to the difference in temperature between the baffle plates and the baffle support. To prevent buckling of the plate, or corrugations of the plates, allowances may be provided in the machine direction by slots 74, 76 and 78 and in the cross machine direction by slots 75 and 77 at the extremities of the plate. The plate is fixed on the center support 60, which locates the plate on the tissue machine. Through the system of the present invention, the baffle plates are free to expand in both the machine direction and the cross machine direction without buckling and contacting the through-air dryer, the fabric, or the rolls while maintaining a seal.

In order to maintain the baffle plates 52 and 54 in position during thermal expansion, the baffle support 56 is connected to a cooling system for maintaining the baffle support at ambient or cooler temperatures. For example, in the embodiment shown in FIG. 3, each of the support elements 58, 60 and 62 are hollow or contain appropriate cooling fluid channels. Each of the support elements 58, 60 and 62 are in fluid communication via a cooling conduit 90. The cooling conduit 90 is connected to a cooling fluid source which circulates a cooling fluid throughout the baffle support. The cooling fluid may be, for instance, ambient air, another suitable gas, water, or any other suitable liquid. By maintaining the baffle support 56 at ambient temperature, the baffle support maintains the ends of the baffle plate in a fixed position in order to prevent the baffle plate from contacting the throughdrying fabric or other parts of the through-air dryer.

In general, the baffle plates 52 and 54 may be made from any suitable material. For example, the baffle plates may be made from a metal, such as steel. Further, the external baffle 50 may include more than 2 baffle plates as shown in FIG. 3.

In an alternative embodiment, the external baffle 50 may comprise a single baffle plate. For example, if a material is used that has a low thermal expansion coefficient, then a single plate may be used. Alternatively, a single plate may also be designed if the temperature difference between the plate and the baffle support in conjunction with the thermal expansion coefficient of the plate are accounted for. For example, if the plate and the baffle support are made from the same material, only the relative temperature differences between the two structures must be accounted for. When dissimilar materials are used, however, the thermal expansion coefficient and the temperature difference must both be taken into account. In accordance with the present invention, the baffle plate may be made from a material having a lower amount of thermal expansion and may be used in conjunction with a baffle support that is maintained at a temperature that is always within a preset temperature range relative to the baffle plate in order to minimize the effects of thermal expansion.

Figure 5:
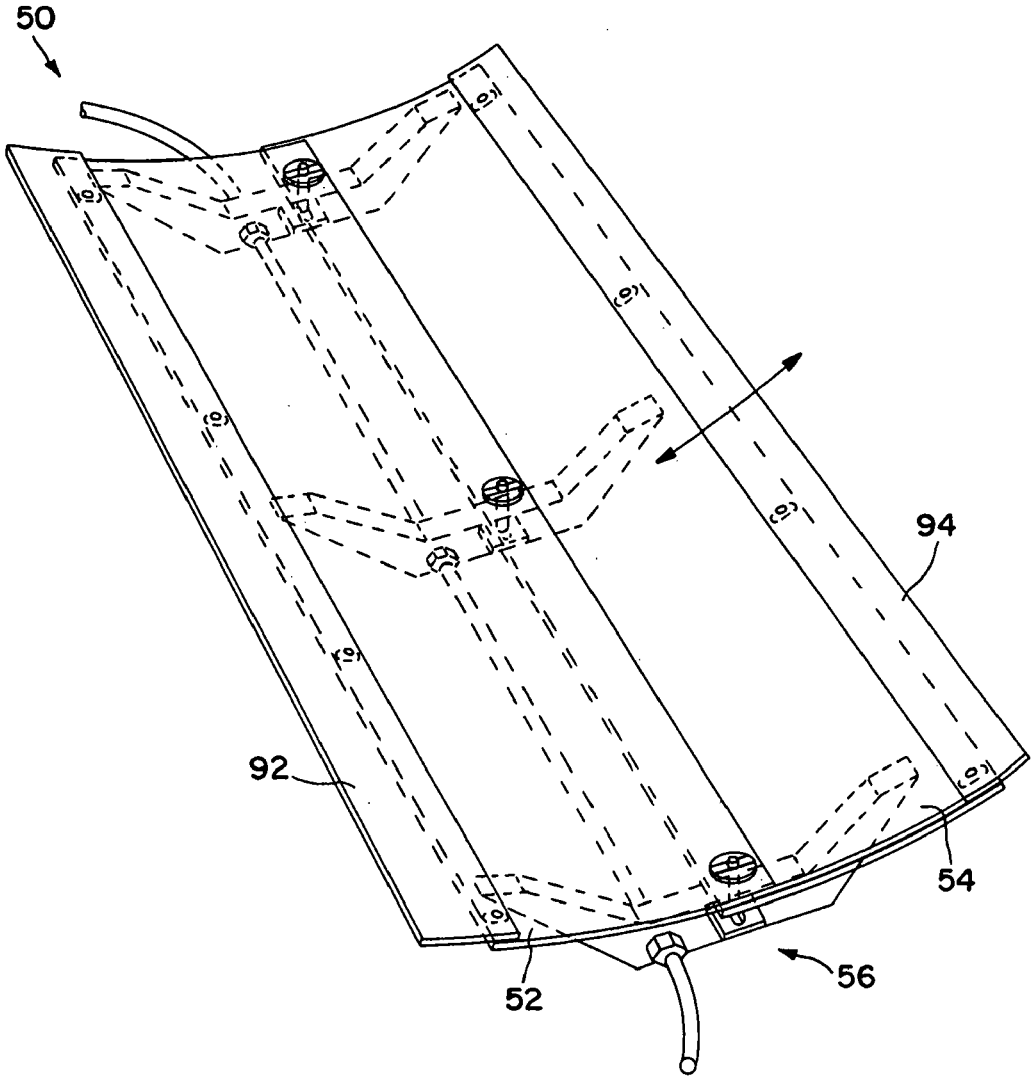
FIG. 5 is a perspective view of another embodiment of an external baffle made in accordance with the present invention.
Figure 6:
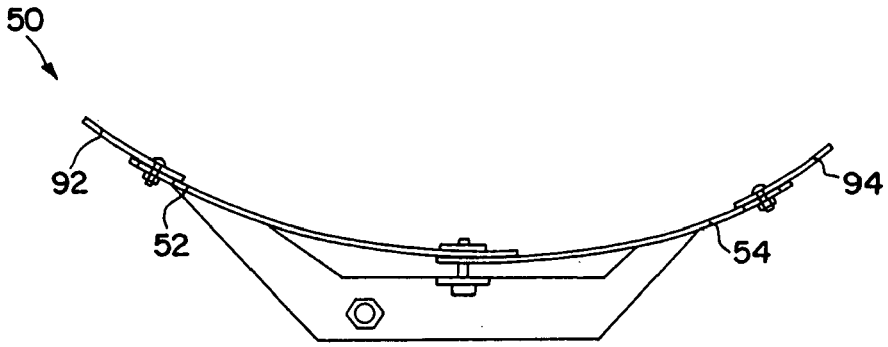
FIG. 6 is a side view of the external baffle illustrated in FIG. 5.

Referring to FIGS. 5 and 6, another embodiment of an external baffle generally 50 made in accordance with the present invention as shown. Like reference numerals have been used to indicate similar elements. For instance, the baffle 50 includes a first baffle plate 52 and a second baffle plate 54. The plates 52 and 54 are connected to a baffle support 56. The baffle support 56 is connected to a cooling system for maintaining the baffle support at lower temperatures.

In this embodiment, the external baffle 50 further includes adjustable ends. In particular, the baffle 50 includes a first end segment 92 and a second end segment 94. The end segments 92 and 94 have an adjustable position with respect to the baffle plates. In particular, the end segments 92 and 94 telescope inward and outward for allowing the external baffle 50 to be precisely positioned with respect to the drying cylinder 26, the throughdrying fabric 24, and the hood 30. In this manner, the ends of the baffle 50 may be positioned as close as possible to the throughdrying fabric 24 without contacting the fabric. For example, for many applications, the ends of the baffle may be placed within about ½ inch of the throughdrying fabric at the upstream end and at the downstream end of the fabric. Further, in one embodiment, the ends of the baffle 50 may also overlap with the ends of the hood 30. By having the hood 30 and the baffle 50 overlap, a continuous seal is provided around the entire circumference of the drying cylinder 26.

In the embodiments shown in FIGS. 5 and 6, the external baffle 50 includes single end segments 92 and 94 positioned on each side of the baffle. It should be understood, however, that further end segments may be included in the construction in order to permit greater adjustment capabilities. For instance, multiple end segments may be included with the baffle to provide a telescoping effect.

Figure 7:
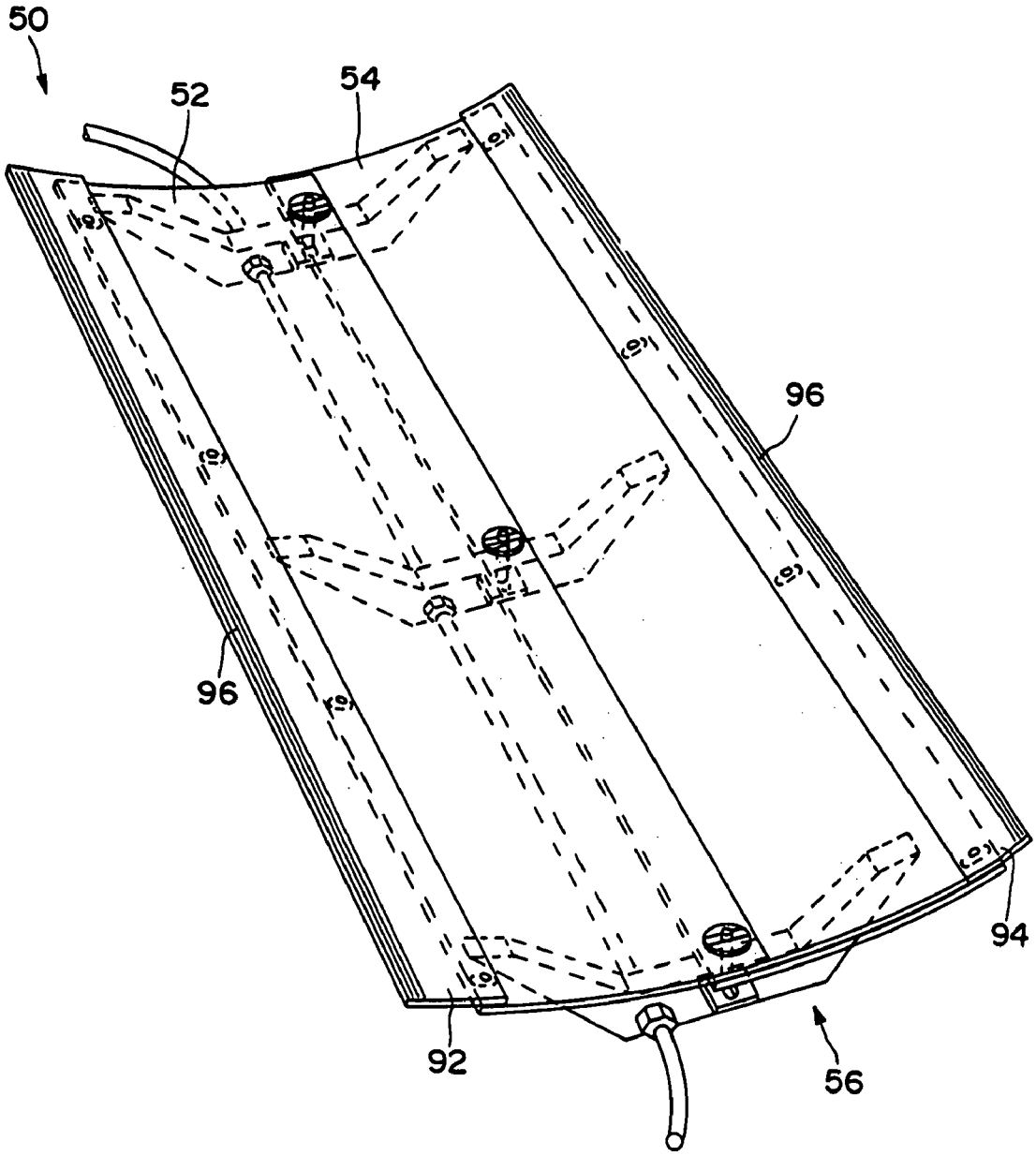
FIG. 7 is a perspective view of another embodiment of an external baffle made in accordance with the present invention.

Referring to FIG. 7, another embodiment of an external baffle generally 50 made in accordance with the present invention is shown. Again, like reference numerals have been included to represent similar elements. The external baffle 50 as shown in FIG. 7, includes a first baffle plate 52 and a second baffle plate 54. The first baffle plate 52 is connected to a first end segment 92 and the second baffle plate 54 is connected to a second end segment 94. In this embodiment, however, each of the end segments 92 and 94 include an anti-friction coating 96. The anti-friction coating 96 is to prevent baffle wear and fabric wear should the baffle contact the throughdrying fabric 24 when positioned adjacent to the drying cylinder 26. The anti-friction coating can be made from any suitable material. The particular material chosen may depend upon the material that is used to form the end segments 92 and 94.

In one embodiment, for instance, the anti-friction coating 96 may be made from a fluorocarbon material. Commercially available flouro carbon materials that may be used in the present invention, for instance, are sold under the trade name TEFLON by Dupont.

These and other modifications and variations to the present invention may be practiced by those of ordinary skill in the art, without department from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. An apparatus for drying a tissue web comprising:

a through-air dryer comprising a porous drying cylinder configured to permit gas flow therethrough and a hood surrounding a portion of the drying cylinder leaving an open free end;

a throughdrying fabric wrapped around the drying cylinder from an upstream point to a downstream point, the throughdrying fabric being guided around the drying cylinder by an upstream guide device and a downstream guide device; and an external baffle positioned over the open free end of the drying cylinder, the external baffle comprising at least two plates, the plates being connected together in a manner that permits thermal extension of the baffle, the external baffle shielding the open free end of the drying cylinder from external air.

2. An apparatus as defined in claim 1, wherein the external baffle extends from the downstream point to the upstream point of the throughdrying fabric without contacting the fabric.

3. An apparatus as defined in claim 1, further comprising an internal baffle positioned within the drying cylinder, the internal baffle being positioned adjacent to the open end of the drying cylinder.

4. An apparatus as defined in claim 1, wherein the external baffle includes a first end and a second end, the first end and the second end having an adjustable length for positioning the external baffle adjacent to the throughdrying fabric.

5. An apparatus as defined in claim 4, wherein the first end and the second end of the external baffle comprise at least one segment that extends and retracts in relation to the plates.

6. An apparatus as defined in claim 4, wherein the first end and the second end of the external baffle are coated with a friction reducing material.

7. An apparatus as defined in claim 1, wherein the external baffle includes a first end and a second end and the hood also includes a first end and a second end, the ends of the baffle overlapping with the ends of the hood around the drying cylinder.

8. An apparatus as defined in claim 1, wherein the plates of the baffle are connected in a manner that allows the plates to slide over one another when undergoing thermal expansion.

9. An apparatus as defined in claim 8, wherein the plates are connected by a connection device, at least one of the plates defining a slot that surrounds the connection device to permit relative movement of the plates.

10. An apparatus as defined in claim 1, wherein the through-air dryer is configured such that a heated gas flows from the hood to the drying cylinder.

11. An apparatus as defined in claim 1, wherein the through-air dryer is configured such that a heated gas flows from the drying cylinder to the hood.

12. An apparatus as defined in claim 1, wherein the external baffle comprises at least three plates.

13. An apparatus as defined in claim 1, further comprising a baffle support for positioning the external baffle adjacent to the drying cylinder, the baffle support being in communication with a cooling system configured to cool the baffle support.

14. An apparatus as defined in claim 13, wherein the cooling system includes a cooling fluid source in communication with at least one cooling fluid channel formed in the baffle support.

15. An apparatus as defined in claim 14, wherein the cooling system is configured to flow air through the cooling fluid channel.

16. An apparatus as defined in claim 14, wherein the cooling system is configured to flow water through the cooling fluid channel.

17. An apparatus as defined in claim 13, wherein the external baffle includes a first end and a second end, the baffle support maintaining the first end and the second end in a fixed position.

18. An apparatus as defined in claim 1, wherein the apparatus is configured such that the throughdrying fabric conveys a tissue web through the through-air dryer without the tissue web contacting any papermaking rolls.

19. An apparatus for drying a tissue web comprising:

a through-air dryer comprising a porous drying cylinder configured to permit gas flow therethrough and a hood surrounding a portion of the drying cylinder leaving an open free end;

a throughdrying fabric wrapped around the drying cylinder from an upstream point to a downstream point, the throughdrying fabric being guided around the drying cylinder by an upstream guide device and a downstream guide device; and an external baffle positioned over the open free end of the drying cylinder, the external baffle shielding in the open free end of the drying cylinder from external air; and a baffle support for positioning the external baffle adjacent to the drying cylinder, the baffle support being in communication with a cooling system configured to cool the baffle support.

20. An apparatus as defined in claim 19, wherein the external baffle comprises at least two plates.

21. An apparatus as defined in claim 20, wherein the plates of the baffle are connected in a manner that allows the plates to slide over one another when undergoing thermal expansion.

22. An apparatus as defined in claim 19, wherein the external baffle extends from the downstream point to the upstream point of the throughdrying fabric without contacting the fabric.

23. An apparatus as defined in claim 19, further comprising an internal baffle positioned within the drying cylinder, the internal baffle being positioned adjacent to the open end of the drying cylinder.

24. An apparatus as defined in claim 19, wherein the external baffle includes a first end and a second end, the first end and the second end having an adjustable length for positioning the external baffle adjacent to the throughdrying fabric.

25. An apparatus as defined in claim 19, wherein the external baffle includes a first end and a second end and the hood also includes a first end and a second end, the ends of the baffle overlapping with the ends of the hood around the drying cylinder.

26. An apparatus as defined in claim 19, wherein the cooling system includes a cooling fluid source in communication with at least one cooling fluid channel formed in the baffle support.

27. An apparatus as defined in claim 26, wherein the cooling system is configured to flow air through the cooling fluid channel.

28. An apparatus as defined in claim 26, wherein the cooling system is configured to flow water through the cooling fluid channel.

29. An apparatus as defined in claim 19, wherein the external baffle includes a first end and a second end, the baffle support maintaining the first end and the second end in a fixed position.

30. An apparatus as defined in claim 19, wherein the apparatus is configured such that the throughdrying fabric conveys a tissue web through the through-air dryer without the tissue web contacting any papermaking rolls.

31. An apparatus as defined in claim 19, wherein the baffle support comprises a plurality of hollow support elements spaced along the external baffle, the support elements being in fluid communication with each other for receiving a cooling fluid therethrough.

32. An apparatus for drying a tissue web comprising:

a through-air dryer comprising a porous drying cylinder configured to permit gas flow therethrough and a hood surrounding a portion of the drying cylinder leaving an open free end;

a throughdrying fabric wrapped around the drying cylinder from an upstream point to a downstream point, the throughdrying fabric being guided around the drying cylinder by an upstream guide device and a downstream guide device; and an external baffle positioned over the open free end of the drying cylinder, the external baffle shielding the open free end of the drying cylinder from external air, the external baffle including a first end and a second end, the first end and the second end having an adjustable length for positioning the external baffle adjacent to the throughdrying fabric.

33. An apparatus as defined in claim 32, wherein the external baffle comprises at least two plates, the plates being connected together in a manner that permits thermal expansion of the baffle.

34. An apparatus as defined in claim 33, wherein the plates of the baffle are connected in a manner that allows the plates to slide over one another when undergoing thermal expansion.

35. An apparatus as defined in claim 32 wherein the external baffle extends from the downstream point to the upstream point of the throughdrying fabric without contacting the fabric.

36. An apparatus as defined in claim 32, further comprising an internal baffle positioned within the drying cylinder, the internal baffle being positioned adjacent to the open end of the drying cylinder.

37. An apparatus as defined in claim 32, wherein the hood includes a first end and a second end, the ends of the baffle overlapping with the ends of the hood around the drying cylinder.

38. An apparatus as defined in claim 32, further comprising a baffle support for positioning the external baffle adjacent to the drying cylinder, the baffle support being in communication with a cooling system configured to cool the baffle support.

39. An apparatus as defined in claim 38, wherein the cooling system includes a cooling fluid source in communication with at least one cooling fluid channel formed in the baffle support.

40. An apparatus as defined in claim 38, wherein the external baffle includes a first end and a second end, the baffle support maintaining the first end and the second end in a fixed position.

41. An apparatus as defined in claim 32, wherein the first end and the second end of the external baffle comprise at least one segment that extends and retracts.

42. An apparatus as defined in claim 32, wherein the first end and the second end of the external baffle are coated with a friction reducing material.

43. An apparatus as defined in claim 32, wherein the apparatus is configured such that the throughdrying fabric conveys a tissue web through the through-air dryer without the tissue web contacting any papermaking rolls.

* * * * *

UNITED STATES PATENT AND TRADEMARK OFFICE

CERTIFICATE OF CORRECTION

PATENT NO. : 6,904,700 B2
APPLICATION NO. : 10/661826
DATED : June 14, 2005
INVENTOR(S) : Frank S. Hada, Michael Alan Hermans and Ronald F. Gropp It is certified that error appears in the above-identified patent and that said Letters Patent is hereby corrected as shown below:

in the list of References Cited, "6,585,086 B2 7/2003 Sandberg et al." should read --6,585,086 B2 7/2003 Ortegren et al. --

Signed and Sealed this

Fourth Day of July, 2006

JON W. DUDAS
*Director of the United States Patent and Trademark Office*